US009554664B2

(12) United States Patent
Bellinghausen

(10) Patent No.: US 9,554,664 B2
(45) Date of Patent: Jan. 31, 2017

(54) DECORATIVE ORNAMENT

(76) Inventor: Wifred John Bellinghausen, Dallas, TX (US)

( * ) Notice: Subject to any disclaimer, the term of this patent is extended or adjusted under 35 U.S.C. 154(b) by 0 days.

(21) Appl. No.: 13/408,130

(22) Filed: Feb. 29, 2012

(65) Prior Publication Data

US 2013/0224402 A1 Aug. 29, 2013

(51) Int. Cl.

| | |
|---|---|
| ***A47G 35/00*** | (2006.01) |
| ***A47G 33/00*** | (2006.01) |
| ***B44C 5/00*** | (2006.01) |
| ***B31D 5/00*** | (2006.01) |
| ***G09F 23/00*** | (2006.01) |

(52) U.S. Cl.

CPC ..... *A47G 35/00* (2013.01); *A47G 33/00* (2013.01); *B31D 5/00* (2013.01); *B44C 5/00* (2013.01); *G09F 23/00* (2013.01)

(58) Field of Classification Search

CPC ..... A63H 33/08; B31D 5/00; B31D 5/05; Y10S 493/955–493/959

USPC ..... 428/7, 27, 98, 101, 121, 3, 4, 28, 542.6; D11/137, 142

See application file for complete search history.

(56) References Cited

U.S. PATENT DOCUMENTS

| | | | | |
|---|---|---|---|---|
| 5,116,687 | A * | 5/1992 | Asano et al. | 428/542.8 |
| 5,645,902 | A * | 7/1997 | Cheng | 428/5 |
| 7,261,948 | B2 * | 8/2007 | Edkins | 428/542.6 |
| 8,252,391 | B2 * | 8/2012 | Vinecombe | 428/12 |
| 2008/0171173 | A1 * | 7/2008 | Vinecombe | 428/98 |

* cited by examiner

*Primary Examiner* — Mark Ruthkosky
*Assistant Examiner* — Julia L Rummel
(74) *Attorney, Agent, or Firm* — Wilson Daniel Swayze, Jr.

(57) ABSTRACT

A decorative object to be decorative may include a first section having a first body member and a first neck member, a second section having a second body member and a second neck member being connected to the first section, a third section having a third body member and a third neck member being connected to the first section. The first section may be looped and the second section may be looped over the first section. The third section may be looped over the second section. The first section may include a hanging extending projection to hang the decorative object.

8 Claims, 19 Drawing Sheets

DECORATIVE ORNAMENT

FIELD OF THE INVENTION

The field of this invention relates to decorative ornaments that are to be usable as bows in gift wrapped packages, holiday ornaments, artificial flowers, decorative displays and other similar usages.

BACKGROUND

Decorative ornaments for use in gift wrapping packages are well known. Normally, such ornaments are constructed of a ribbon and are arranged in a plurality of loops that extend from a central core normally called a bow. The problem with bows at the present time is that such are all of the same type. It would be desirable to produce different types of decorative ornaments that have different appearances.

SUMMARY

A decorative object to be decorative may include a first section having a first body member and a first neck member, a second section having a second body member and a second neck member being connected to the first section, a third section having a third body member and a third neck member being connected to the first section.

The first section may be looped and the second section may be looped over the first section. The third section may be looped over the second section.

The first section may include a hanging extending projection to hang the decorative object.

The second section may include a noncontinuous slit.

The noncontinuous slit may be defined as an area for indicia, and the noncontinuous slit may be defined as a Angels head.

The noncontinuous slit may be defined as a cowboy hat, and the noncontinuous slit may be defined as a baseball cap.

The noncontinuous slit may be defined as a Halloween head, and the main body may include a projecting lip which corresponds to a tail feather.

The main body may include a projecting lip which corresponds to a wing feather, and the decorative object may include a fourth section having a fourth main member and a fourth neck member.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
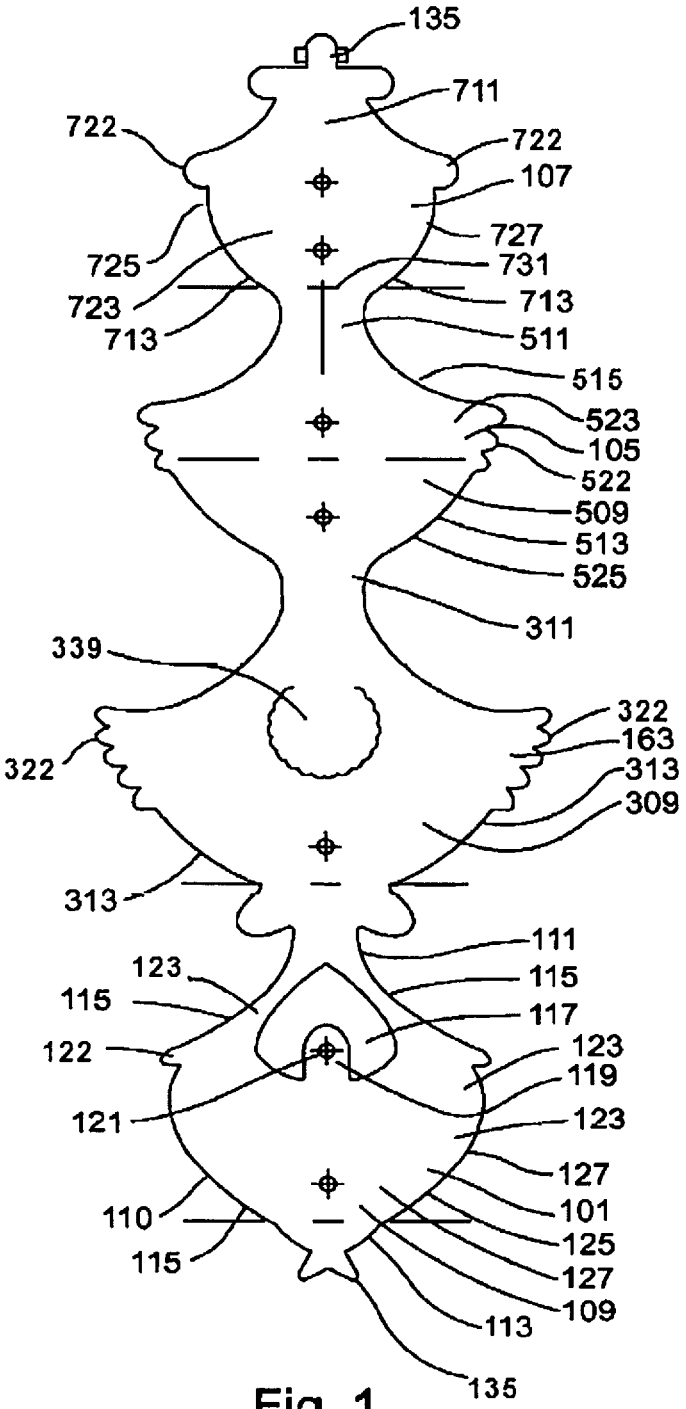
FIG. 1 illustrates a top view of the decorative object of the present invention.

FIG. 1 illustrates a flexible sheet 100 which is shown in a unfolded position and which may be formed into a decorative ornament 100. The decorative ornament 100 of the present invention may include a multitude of sections which may be placed in an over lapping relationship and being wound with several revolutions or looped on top of each other. The decorative ornament 100 may be formed to represent familiar objects such as an angel, a cowboy hat, a baseball cap, a Halloween figure, and Eagles head, a Horsehead or the like. The material for the decorative ornament 100 could comprise flexible paper, cardboard, plastic, polyester, polypropylene including blown polypropylene ribbon material, vinyl, papers, and laminates thereof such as combining paper and polypropylene. The materials can be tinted, printed, metallized, embossed, holographic and similar processes.

The decorative ornament 100 may include a first section 101, a second section 103, a third section 105 and a fourth section 107. The decorative ornament 100 maybe formed from transparent or translucent material and may include a light which may be an LED light to be mounted within or adjacent to the decorative ornament 100.

The first section 101 may include a first body member 109 which may be connected to a first neck member 111 which may be connected to the second body member of the second section 103 and which may include first top surface 123 and an opposing first bottom surface 125 which may be connected by a pair of opposing first side surfaces 127. The first top surface 123 may include a traverse slot 131 which may extend through to the bottom surface 125 to cooperate with a fastener 135. The fastener 135 may be appropriately sized and may be enlarged for easier handling. The fastener 135 may be a side catch that may avoid the need for folding. The first side surface 127 may be a mirror the opposing first side surface 127 and may include a first section convex side surface 113 which may be connected to a first section concave side surface 115.

FIG. 1 additionally illustrates that the first body member 109 may include a first aperture 117 which may be defined by curved edges and may be defined by a inward extending projection 119 which may include a second aperture 121 to be used to hang the decorative ornament 100. The first body member 109 may include an outward extending projecting lip 122 which may extend from the first body member 109 and may include a projecting lip 122 which may correspond to tail feathers for the decorative ornament 100.

The second section 103 may include a second body member 309 which may be connected to a second neck member 311 which may be connected to the second body member of the third section 105 and which may include a second top surface 323 and an opposing second bottom surface 325 which may be connected by a pair of opposing second side surfaces 327. The second top surface 323 may include a traverse slot 331 which may extend through to the bottom surface 325 to cooperate with a fastener 135. The second side surface 327 may be a mirror of the opposing second side surface 327 and may include a second section convex side surface 313 which may be connected to a second section concave side surface 315.

FIG. 1 additionally illustrates that the second body member 309 may include a noncontinuous slit 339 which may extend through the second body member 309 which may define an area 341 of indicia of a face for example an angel's face or other appropriate indicia. The second body member 309 may include an outward extending projecting lip 322 which may extend from the second body member 309 and may include a projecting lip 322 which may correspond to tail feathers for the decorative ornament 100.

The third section 105 may include a third body member 509 which may be connected to a third neck member 511 which may be connected to the fourth body member of the fourth section 107 and which may include a third top surface 523 and an opposing third bottom surface 525 which may be connected by a pair of opposing third side surfaces 527. The third top surface 523 may include a traverse slot 531 which may extend through to the bottom surface 525 to cooperate with a fastener 135. The third side surface 527 may be a mirror of the opposing third side surface 527 and may include a third section convex side surface 513 which may be connected to a third section concave side surface 515.

The third body member 509 may include an outward extending projecting lip 522 which may extend from the third body member 509.

The fourth section 107 may include a fourth body member 709 which may be connected to a fourth neck member 711 which may be connected to the fourth body member 709 of the fourth section 107 and which may include a fourth top surface 723 and an opposing fourth bottom surface 725 which may be connected by a pair of opposing fourth side surfaces 727. The fourth top surface 723 may include a traverse slot 731 which may extend through to the fourth bottom surface 725 to cooperate with a fastener 135. The fourth side surface 727 may be a mirror of the opposing fourth side surface 727 and may include a fourth section convex side surface 713 which may be connected to a fourth section concave side surface 715.

The fourth body member 709 may include an outward extending projecting lip 722 which may extend from the fourth body member 709. The fourth neck member 711 may be connected to a fastener device 135 which may connect the first section 101, the second section 103, the third section 105 and the fourth section 107 by being folded over and formed into a looped relationship with respect to the first section 101, the second section 103, the third section 105 and the fourth section 107.

Figure 2:
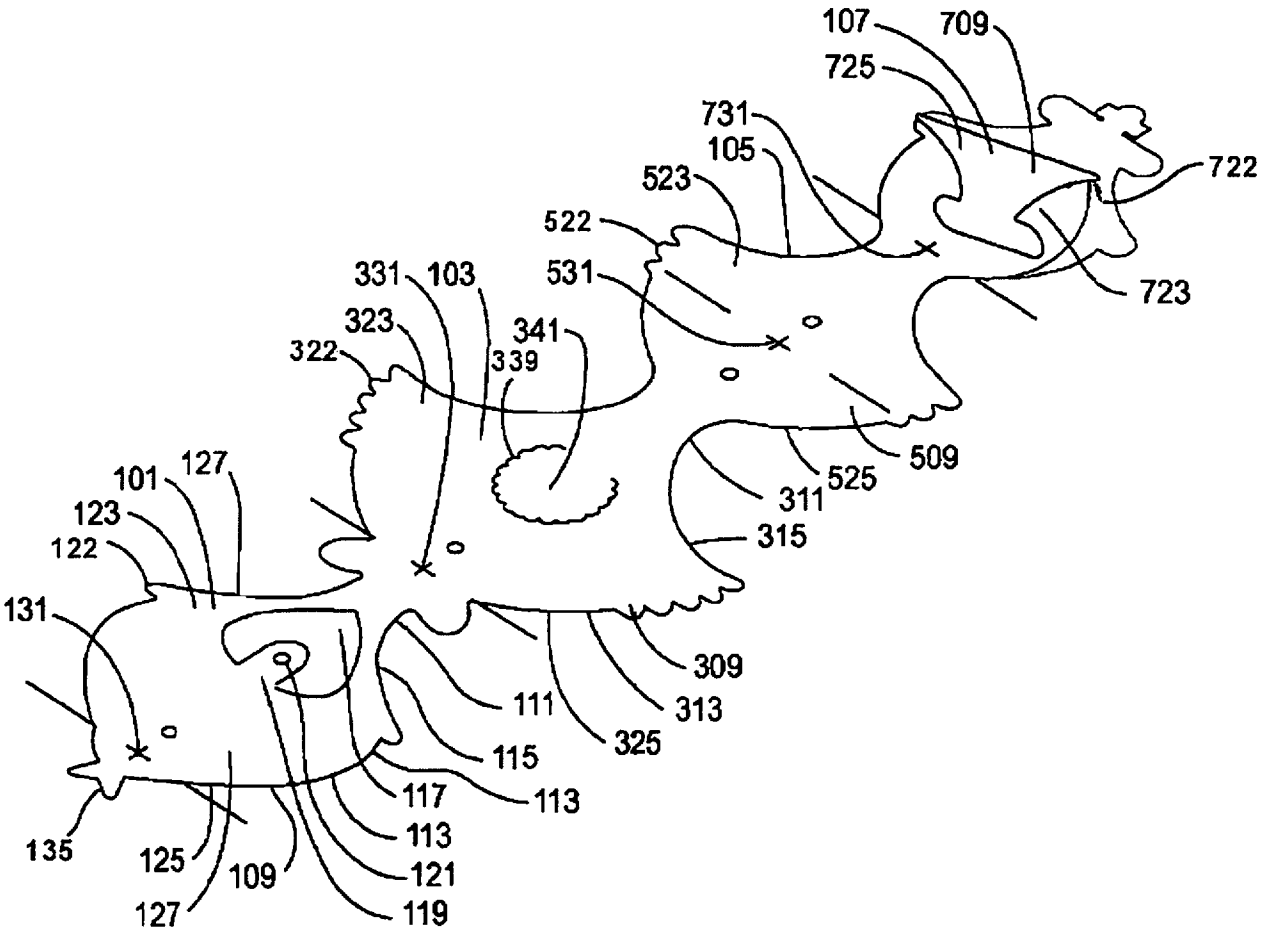
FIG. 2 illustrates a perspective view of the decorative object of the present invention.

FIG. 2 illustrates a flexible sheet 100 which is shown in a partially folded position and which may be formed into a decorative ornament 100. The decorative ornament 100 of the present invention may include a multitude of sections which may be placed in an over lapping relationship and being wound with several revolutions on top of each other. The decorative ornament 100 may be formed to represent familiar objects such as an angel, a cowboy hat, a baseball cap, a Halloween figure, and Eagles head, a Horsehead or the like.

The decorative ornament 100 may include a first section 101, a second section 103, a third section 105 and a fourth section 107.

The first section 101 may include a first body member 109 which may be connected to a first neck member 111 which may be connected to the second body member of the second section 103 and which may include first top surface 123 and an opposing first bottom surface 125 which may be connected by a pair of opposing first side surfaces 127. The first top surface 123 may include a traverse slot 131 which may extend through to the bottom surface 125 to cooperate with a fastener 135 (not shown). The first side surface 127 may be a mirror of the opposing first side surface 127 and may include a first section convex side surface 113 which may be connected to a first section concave side surface 115.

FIG. 1 additionally illustrates that the first body member 109 may include a first aperture 117 which may be defined by curved edges and may be defined by a inward extending projection 119 which may include a second aperture 121 to be used to hang the decorative ornament 100. The first body member 109 may include an outward extending projecting lip 123 which may extend from the first body member 109 and may include a projecting lip 122 which may correspond to tail feathers for the decorative ornament 100.

The second section 103 may include a second body member 309 which may be connected to a second neck member 311 which may be connected to the second body member of the third section 105 and which may include a second top surface 323 and an opposing second bottom surface 325 which may be connected by a pair of opposing second side surfaces 327. The second top surface 323 may include a traverse slot 331 which may extend through to the bottom surface 325 to cooperate with a fastener 135. The second side surface 327 may be a mirror of the opposing second side surface 327 and may include a second section convex side surface 313 which may be connected to a second section concave side surface 315.

FIG. 2 additionally illustrates that the second body member 309 may include a noncontinuous slit 339 which may extend through the second body member 309 which may define an area 341 of indicia of a face for example an angel's face or other appropriate indicia. The second body member 309 may include an outward extending projecting lip 322 which may extend from the second body member 309 which may correspond to wing feathers and may include a projecting lip 322 which may correspond to tail feathers for the decorative ornament 100.

The third section 105 may include a third body member 509 which may be connected to a third neck member 511 which may be connected to the fourth body member of the fourth section 107 and which may include a third top surface 523 and an opposing third bottom surface 525 which may be connected by a pair of opposing third side surfaces 527. The third top surface 523 may include a traverse slot 531 which may extend through to the bottom surface 525 to cooperate with a fastener 135. The third side surface 527 may be a mirror of the opposing third side surface 527 and may include a third section convex side surface 513 which may be connected to a third section concave side surface 515.

The third body member 509 may include an outward extending projecting lip 522 which may extend from the third body member 509.

The fourth section 107 may include a fourth body member 709 which may be connected to a fourth neck member 711 which may be connected to the fourth body member of the fourth section 107 and which may include a fourth top surface 723 and an opposing fourth bottom surface 725 which may be connected by a pair of opposing fourth side surfaces 727. The fourth top surface 723 may include a traverse slot 731 which is shown having the fastener 135 extending through the traverse slot 731 to hold the fourth section 107 and which may extend through to the fourth bottom surface 725 to cooperate with a fastener 135. The fourth side surface 727 may be a mirror of the opposing fourth side surface 727 and may include a fourth section convex side surface 713 which may be connected to a fourth section concave side surface 715.

The fourth body member 709 may include an outward extending projecting lip 723 which may extend from the fourth body member 709. The fourth neck member 711 may be connected to a fastener device 135 which may connect the first section 101, the second section 103, the third section 105 and the fourth section 107 by being folded over and formed into a looped relationship with respect to the first section 101, the second section 103, the third section 105 and the fourth section 107.

The fourth section 107 has been folded over and secured by the fastening device 135 by the cooperation of the fourth slit 731.

Figures 3, 4:
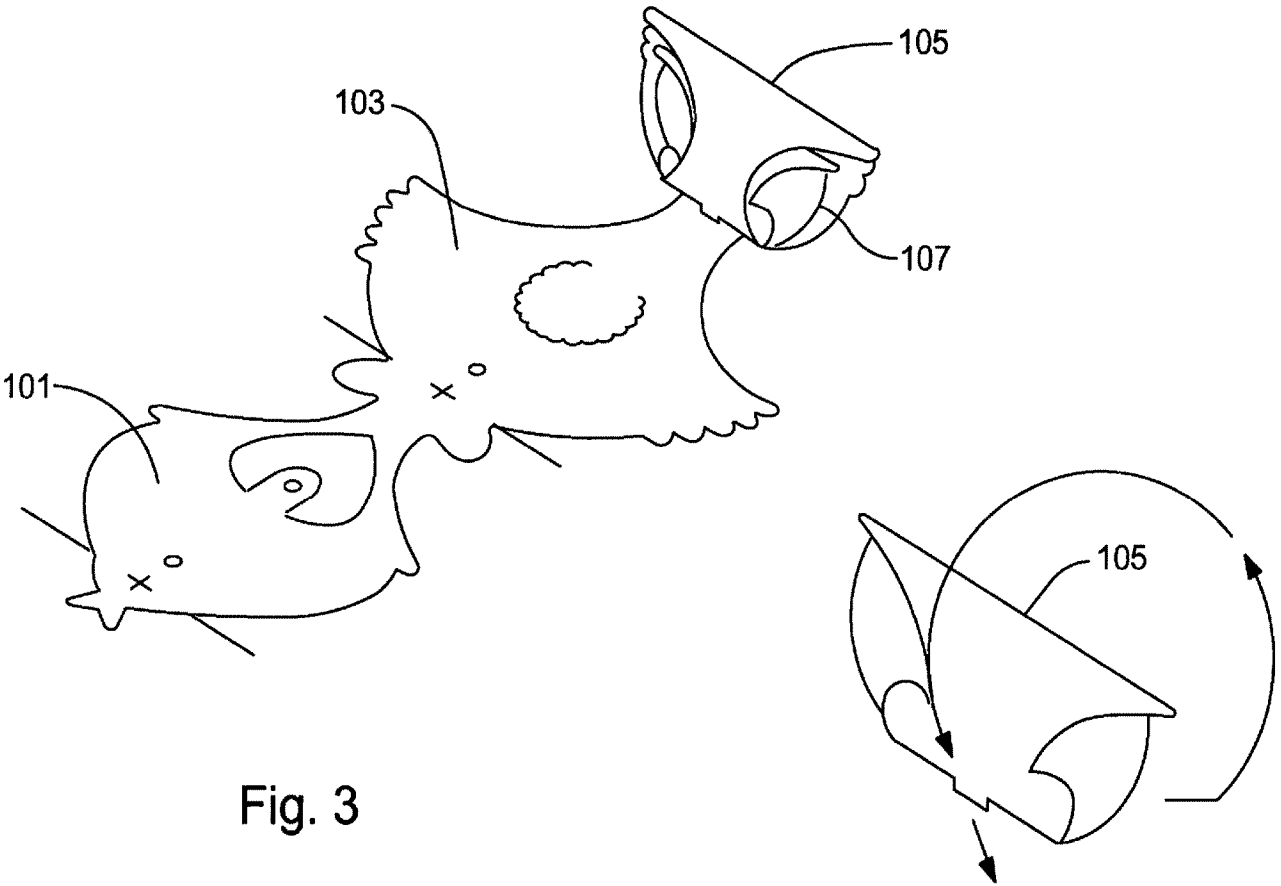
FIG. 3 illustrates a perspective view of the decorative object of the present invention.
FIG. 4 illustrates a portion of the decorative object of the present invention.

FIG. 3 illustrates the decorative object 100 of the present invention and illustrates the first section 101, the second section 103, the third section 105 and the fourth section 107. The third section 105 has been folded over and placed in a looped relationship and the fastener device 135 has been inserted into the slit 531 to hold the third section 105 in position.

The first section 101 and the second section 103 have not been folded over.

FIG. 4 illustrates the third section 105 being folded over to be placed in a looped relationship with respect to the fourth section 107.

Figure 5:
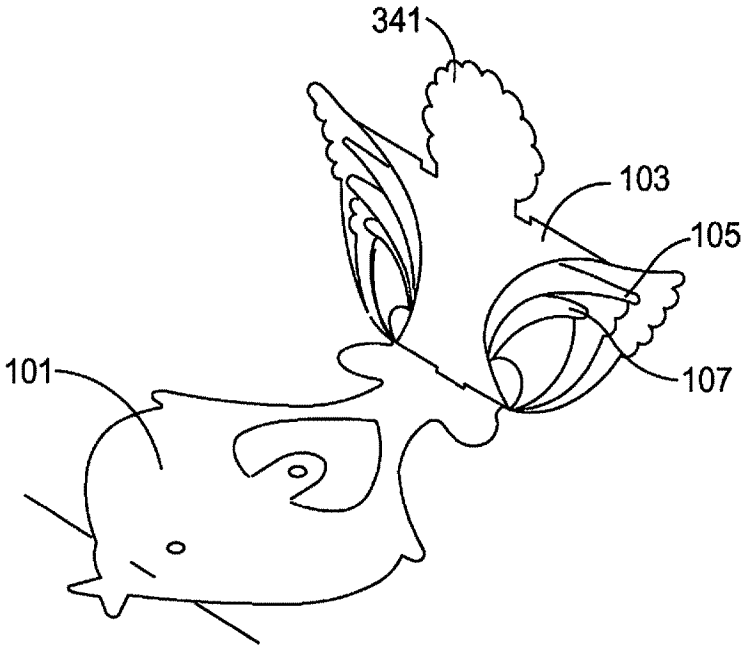
FIG. 5 illustrates a perspective view of the decorative object of the present invention.

FIG. 5 illustrates the decorative object 100 of the present invention and illustrates the first section 101, the second section 103, the third section 105 and the fourth section 107. The second section 103, the third section 105, and the fourth section 107 has been folded over and placed in a looped relationship and the fastener device 135 has been inserted into the slit 331 to hold the second section 103 in position.

The first section 101 has not been folded over. FIG. 5 illustrates that the area 341 may be extended upwards from the top surface 323 of the second section 103 and may be decorated with indicia such as an Angel's face in order to add to the decorative appeal of the decorative device 100.

Figure 6:
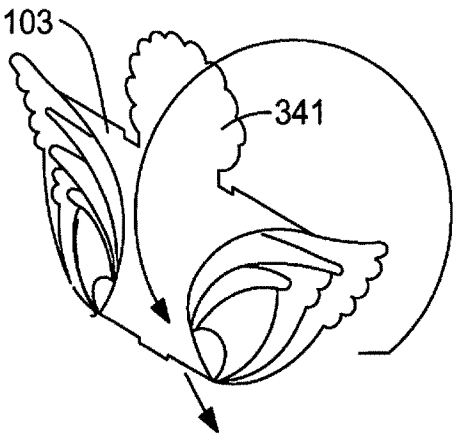
FIG. 6 illustrates a perspective view of the decorative object of the present invention.

FIG. 6 illustrates that the fastening device 135 has been inserted through the slit 331 to hold the second section 103 in position.

Figure 7:
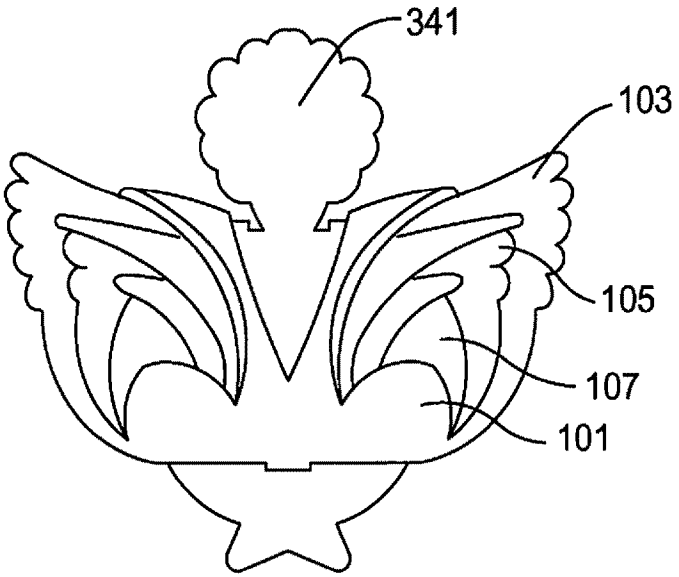
FIG. 7 illustrates a perspective view of the decorative object of the present invention.

FIG. 7 illustrates the decorative object 100 of the present invention and illustrates the first section 101, the second section 103, the third section 105 and the fourth section 107. The first section 101, the second section 103, the third section 105, and the fourth section 107 has been folded over and placed in a looped relationship and the fastener device 135 has been inserted into the slit 131 to hold the first section 101 in position.

FIG. 7 illustrates that the area 341 may be extended upwards from the top surface 323 of the second section 103 and through the aperture 117 of the first section 101 and may be decorated with indicia such as an Angel's face in order to add to the decorative appeal of the decorative device 100.

Figure 8:
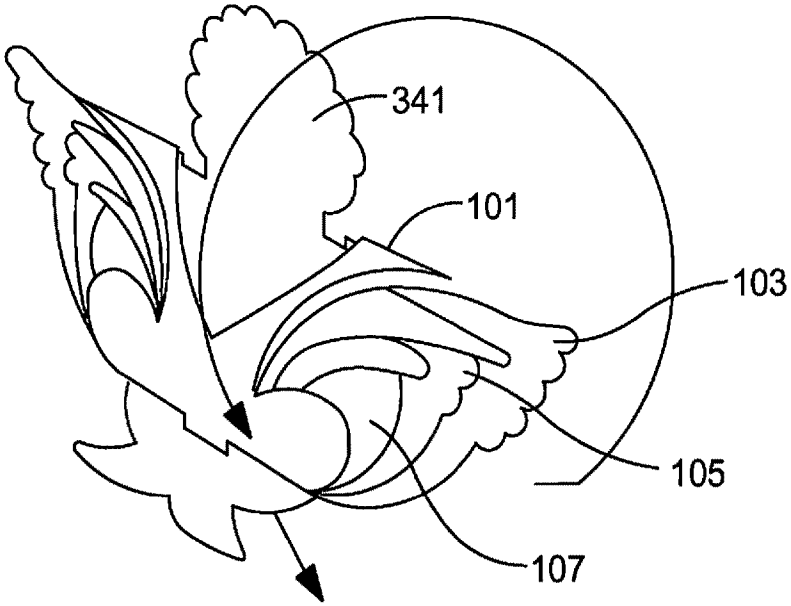
FIG. 8 illustrates a perspective view of the decorative object of the present invention.

FIG. 8 illustrates that the fastening device 135 has been inserted through the slit 131 to hold the first section 101 in position.

Figure 9:
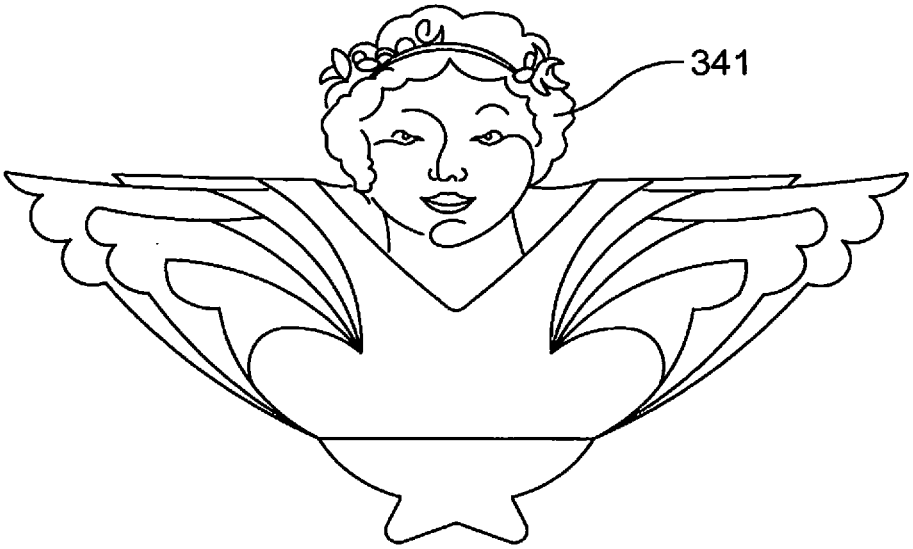
FIG. 9 illustrates a front view of the decorative object of the present invention.

FIG. 9 illustrates that the area 341 has been formed in the shape of an angel's head with indicia to complement the shape.

Figure 10:
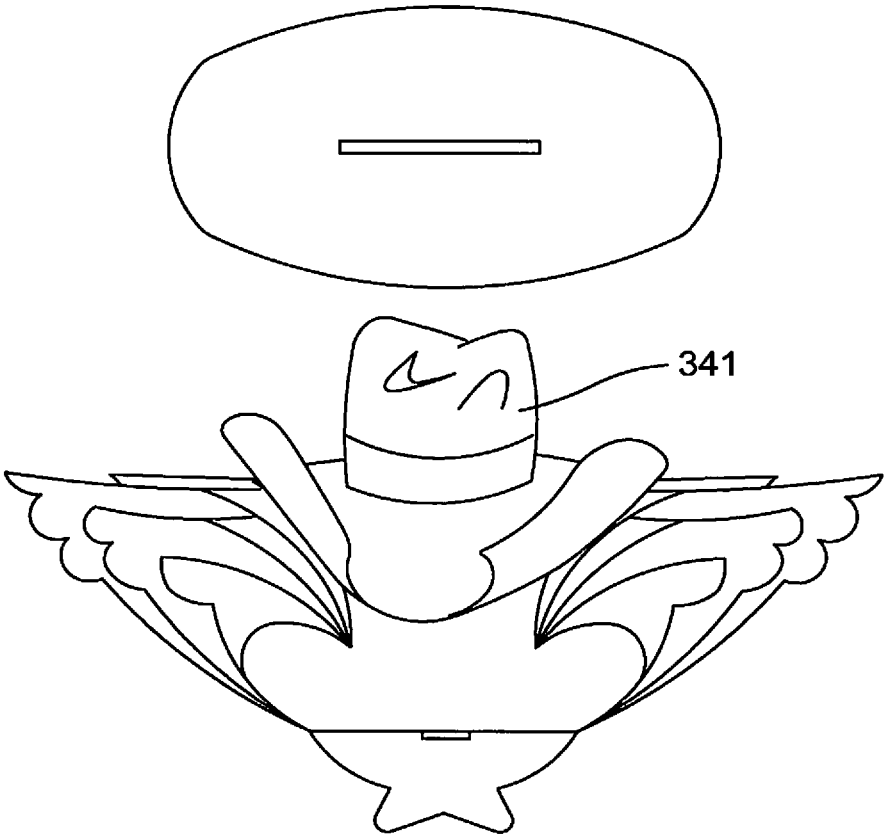
FIG. 10 illustrates a front view of another decorative object of the present invention.

FIG. 10 illustrates that the area 341 has been formed in the shape of a cowboy hat with indicia to support the shape of the area 341.

Figure 11:
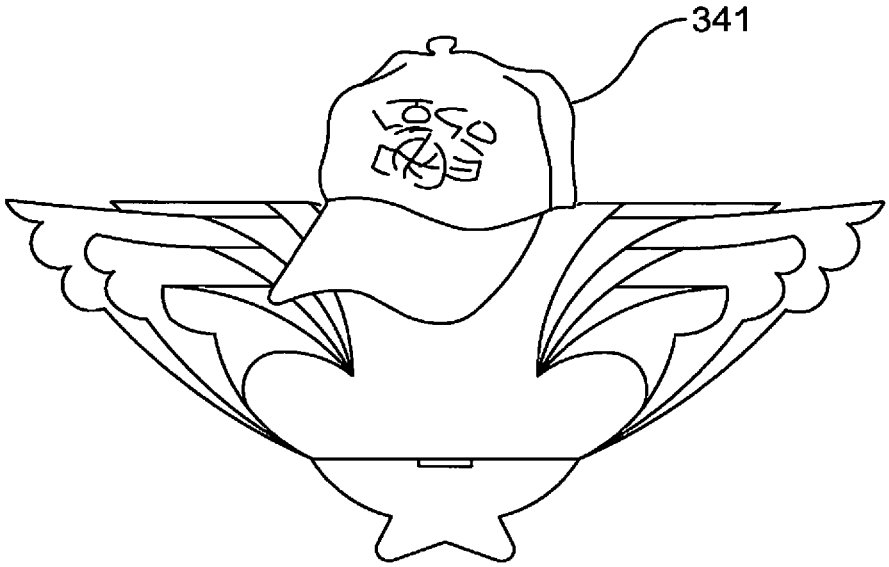
FIG. 11 illustrates a front view of another decorative object of the present invention.

FIG. 11 illustrates that the area 341 maybe formed in the shape of a baseball cap with the indicia to support the shape of the area 341.

Figure 12:
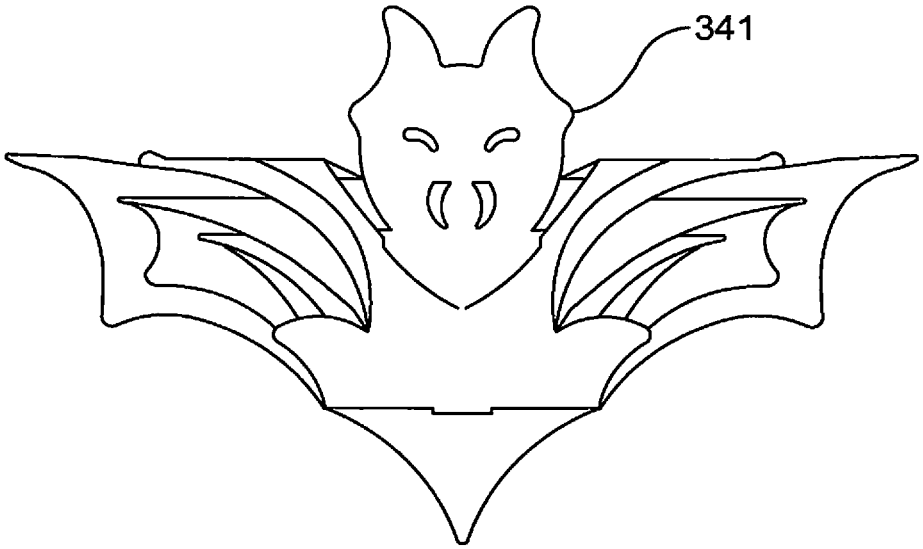
FIG. 12 illustrates another decorative object of the present invention.

FIG. 12 illustrates that the area 341 maybe formed in the shape of a Halloween figure with indicia to support the shape of the area 341.

Figure 13:
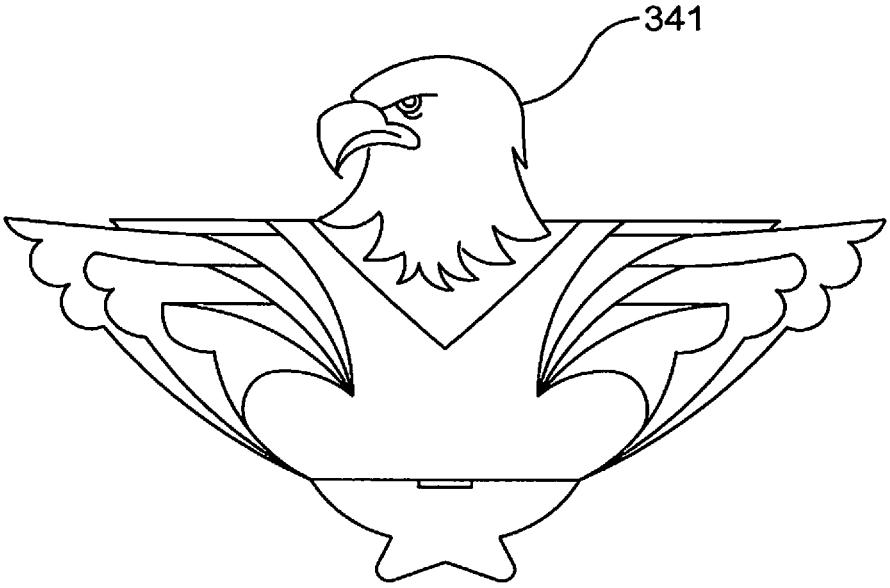
FIG. 13 illustrates a front view of another decorative object of the present invention.

FIG. 13 illustrates that the area 341 maybe formed in the shape of a Eagles head with indicia to support the shape of the area 341.

Figure 14:
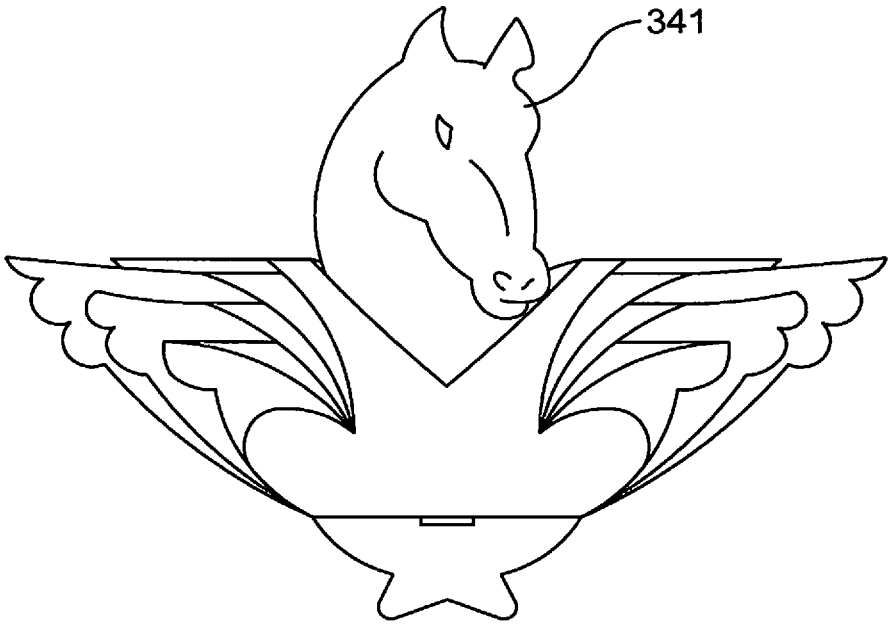
FIG. 14 illustrates a front view of another decorative object of the present invention.

FIG. 14 illustrates that the area 341 maybe formed in the shape of a Horsehead with indicia to support the shape of the area 341.

Figure 15:
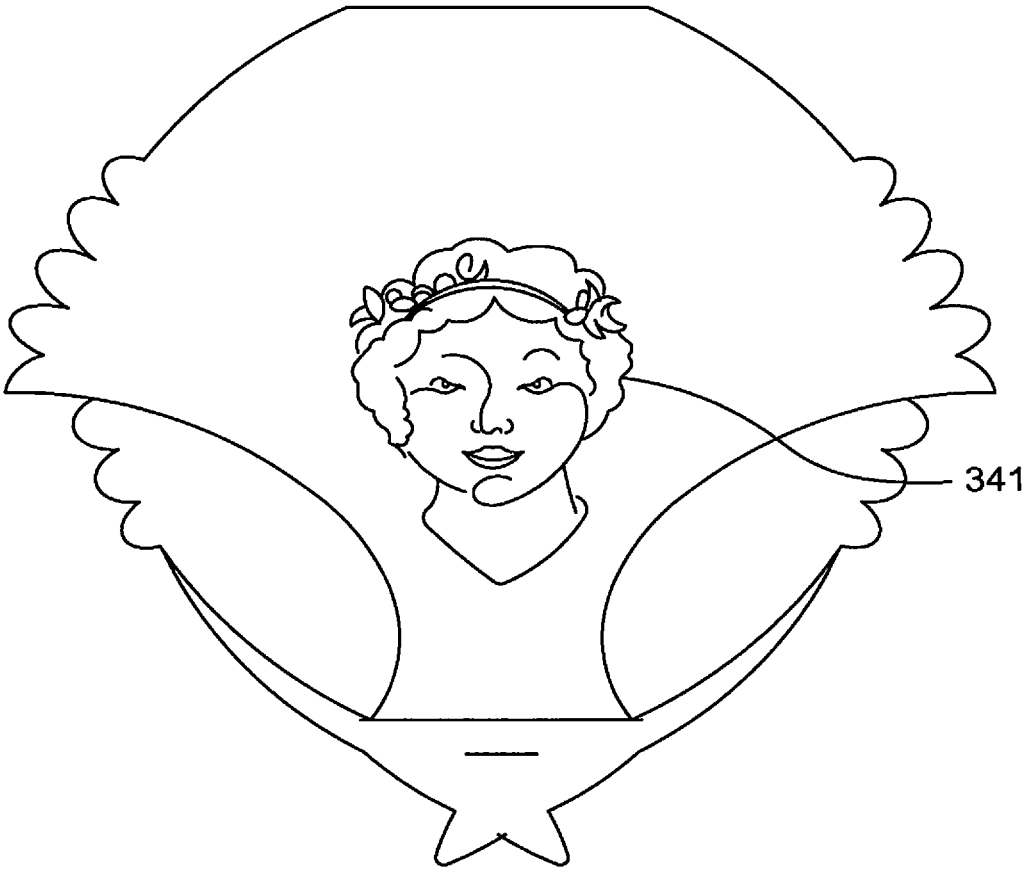
FIG. 15 illustrates a front view of another decorative object of the present invention.

FIG. 15 illustrates that the area 341 may be in the shape of an Angel head with the indicia to support the shape of the area 341.

Figure 16:
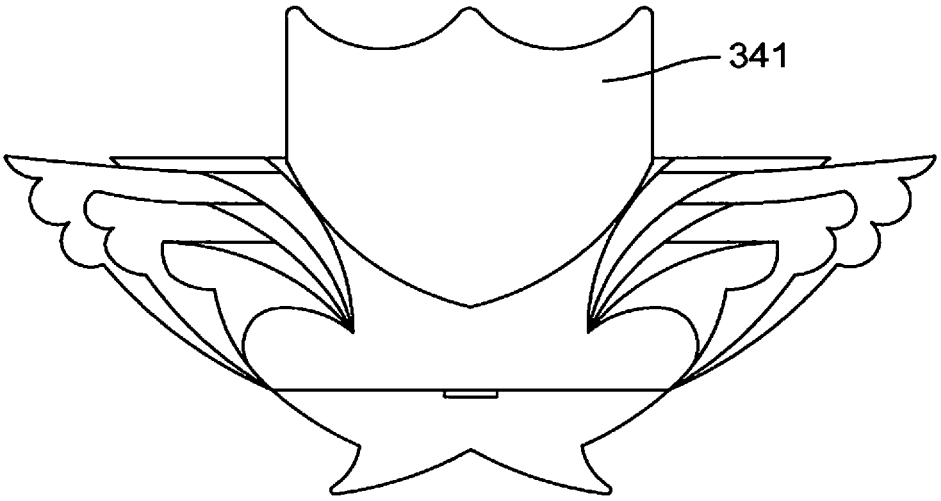
FIG. 16 illustrates a front view of another decorative object of the present invention.

FIG. 16 illustrates that the area 341 may be in the shape of a shield with the indicia to support the shape of area 341.

Figure 17:
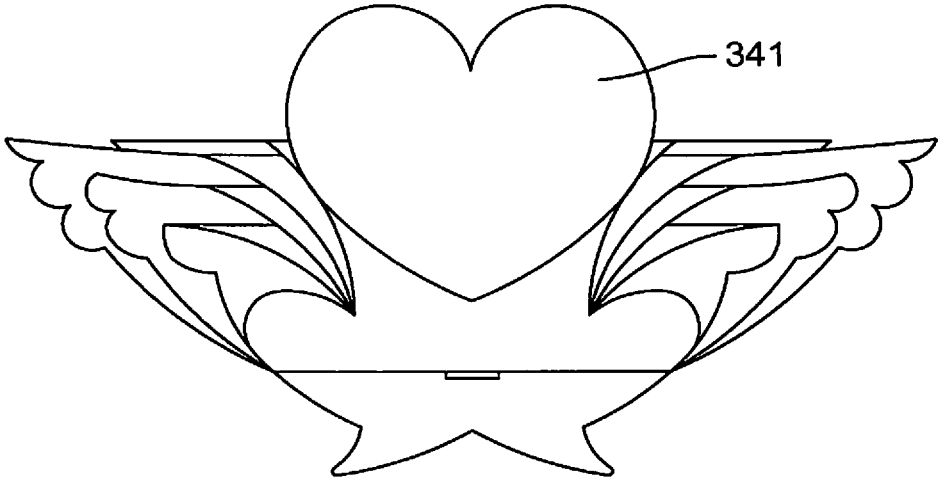
FIG. 17 illustrates a front view of another decorative object of the present invention.

FIG. 17 illustrates that the area 341 may be in the shape of a heart.

Figure 18:
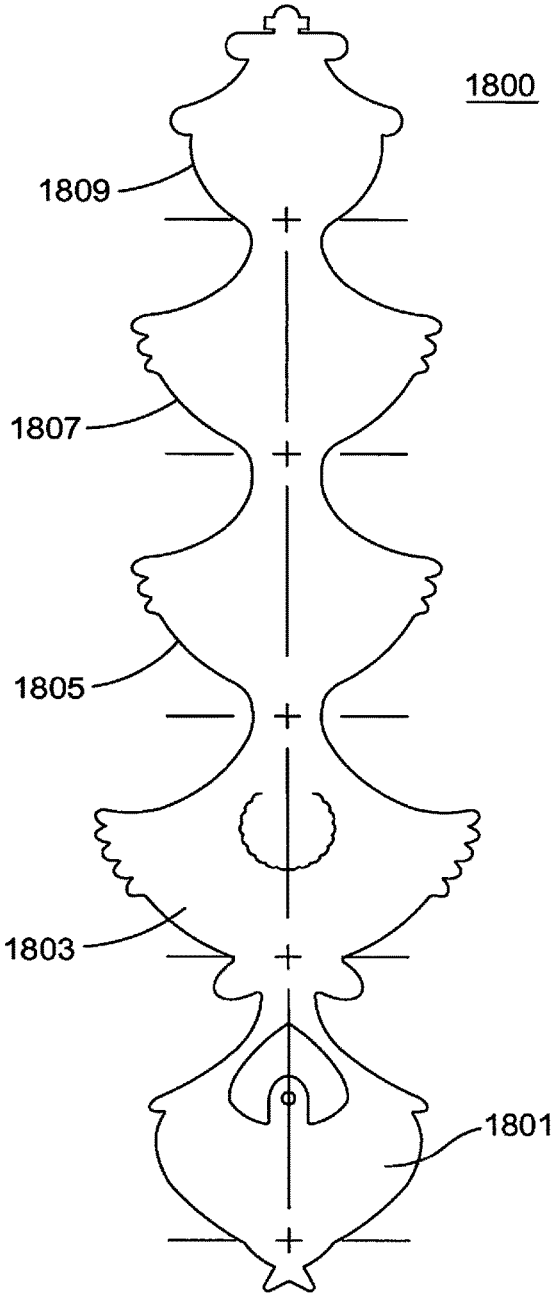
FIG. 18 illustrates a top view of another decorative object of the present invention.

FIG. 18 illustrates a decorative object 1800 which may include five sections and may include a first section 1801 which may correspond to the first section 101 of the decorative object 100, a second section 1803 which may correspond to the second section 103 of the decorative object 100, a third section 1805 and a fourth section 107 which may correspond to the third section 105 of the decorative object 100 and a fifth section 1809 which may correspond to the fourth section 107 of the decorative object 100.

Figure 19:
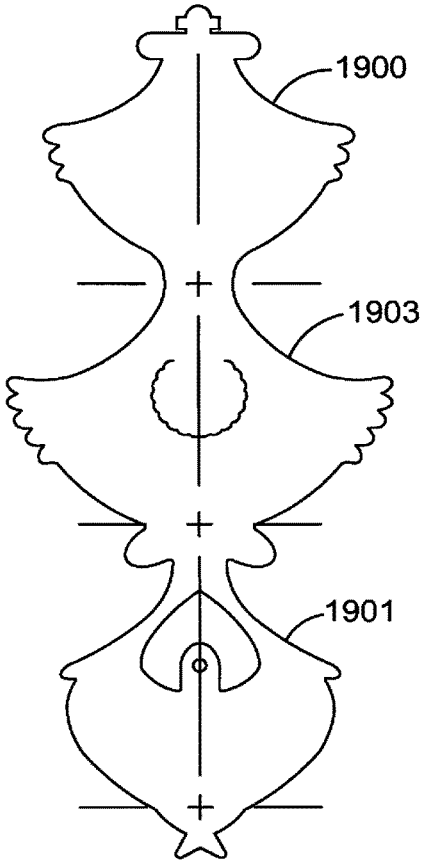
FIG. 19 illustrates a top view of another decorative object of the present invention.

FIG. 19 illustrates a decorative object 1900 which may include three section and which may include a first section 1901 which may correspond to the first section 101 of the decorative object 100, a second section 1903 which may correspond to the second section 103 of the decorative object 100 and a third section 105 of the decorative object 100 and a third section 1905 which may correspond to the fourth section 107 of the decorative object 100.

Figure 20:
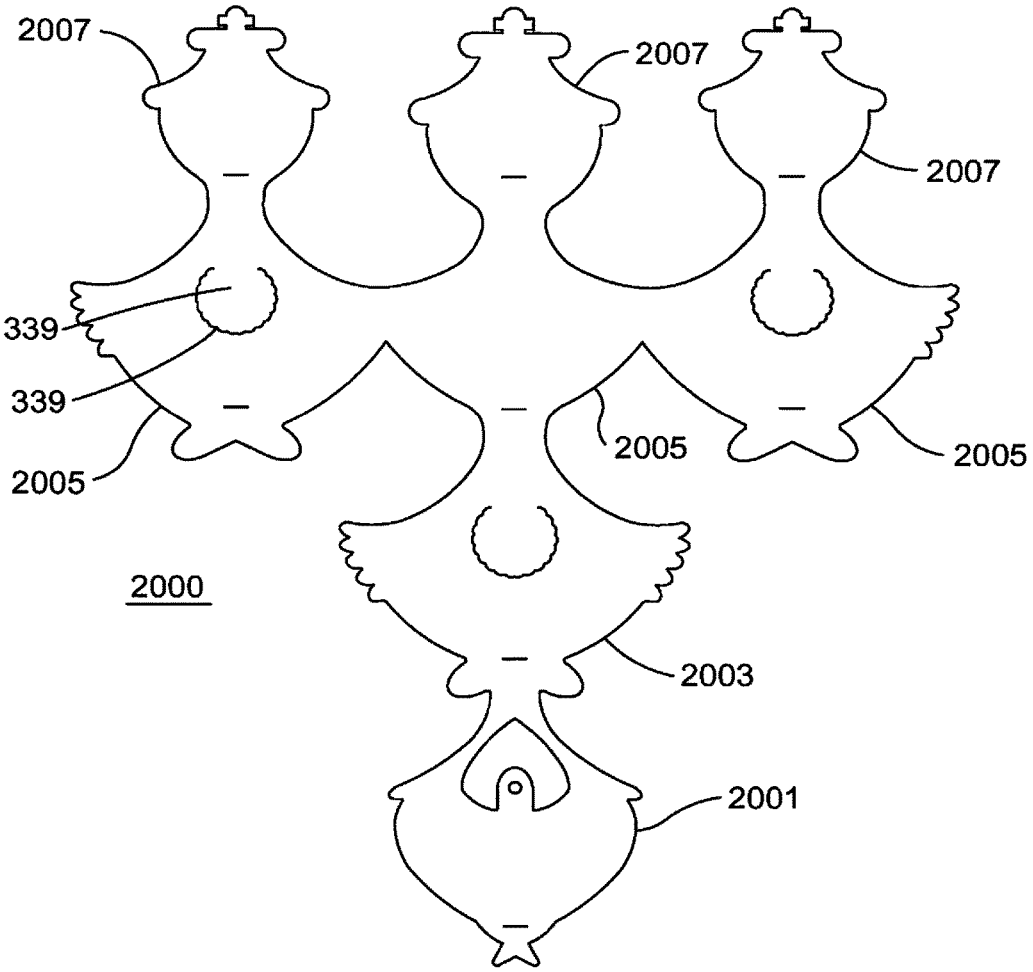
FIG. 20 illustrates a top view of another decorative object of the present invention.

FIG. 20 illustrates a decorative object 2000 which may include four sections 2001, 2003, 2005, 2007 where two sections 2005-1 may be connected in parallel to section 2005 and may be substantially multiple mirror sections of section

2005 and which may include a first section 2001 which may correspond to the first section 101 of the decorative object 100, a second section 2003 which may correspond to the second section 103 of the decorative object 100, a third section 2005 which may correspond to the third section 105 of the decorative object 100 and a fourth section 2007 which may correspond to the fourth section 107 of the decorative object 100.

The third sections 2005-1 may include a noncontinuous slit 339 to define an area 341. The third sections 2005-1 may be connected to the side of the third section 2005 and may be connected to a fourth section 2007.

Figure 21:
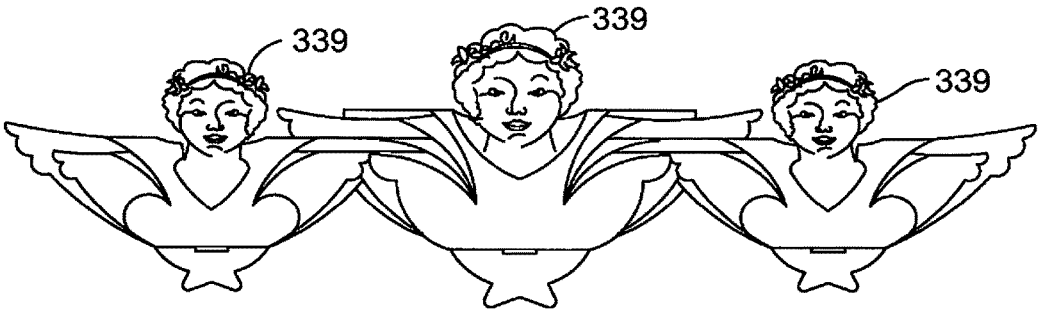
FIG. 21 illustrates a perspective view of the decorative object of the present invention.
Figure 22:
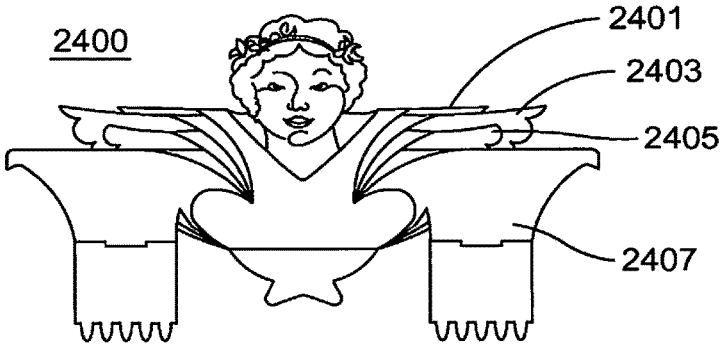
FIG. 22 illustrates a perspective view of the decorative object of the present invention.
Figure 23:
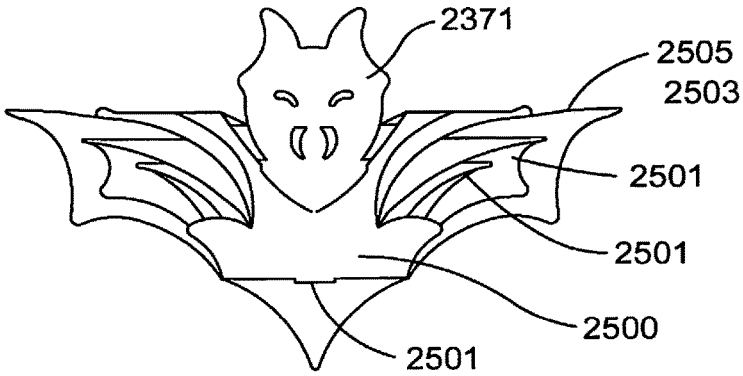
FIG. 23 illustrates a perspective view of the decorative object of the present invention.

FIG. 21 illustrates the result of looping the first section 2001, the second section 2003, the third sections 2005, 2005-1 and the fourth sections 2007. FIG. 21 illustrates a multitude of decorative objects.

Figure 24:
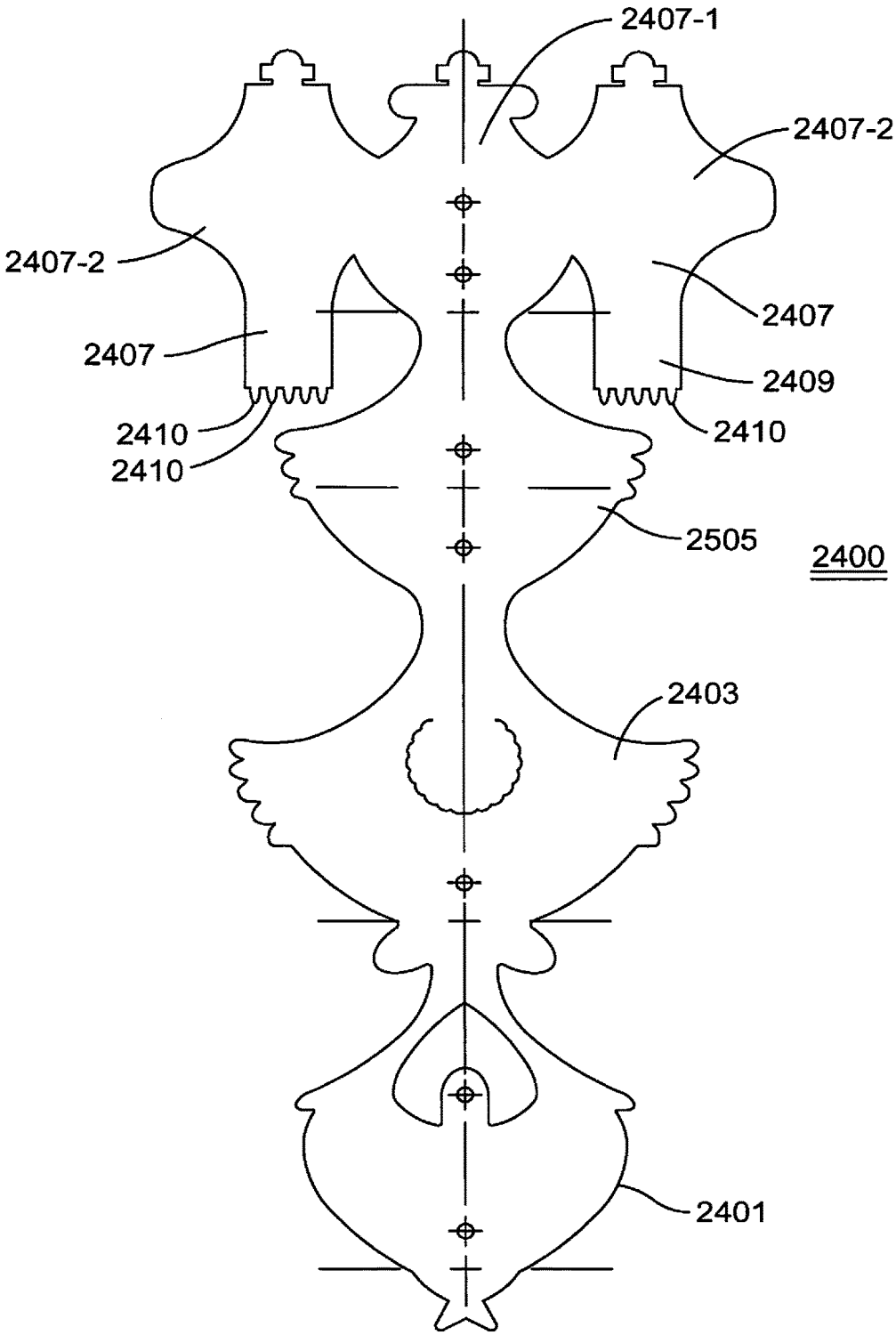
FIG. 24 illustrates a top view of the decorative object of the present invention.

FIG. 24 illustrates a decorative object 2400 which may include a first section 2401 which may correspond to the first section 101 of the decorative object 100, a second section 2403 which may correspond to the second section 103 of the decorative object 100, a third section 2405 which may correspond to the third section 105 of the decorative object 100 and a fourth section 2407. The fourth section 2407 may include a middle section 2407-1 and a pair of opposing side sections 2407-2 which may be connected on opposing sides of the middle section 2407-1. The side sections 2407-2 may include a bottom panel 2409 which may extend from the bottom of the side sections 2407-2. The bottom panel will 2409 may include projections 2410.

Figure 25:
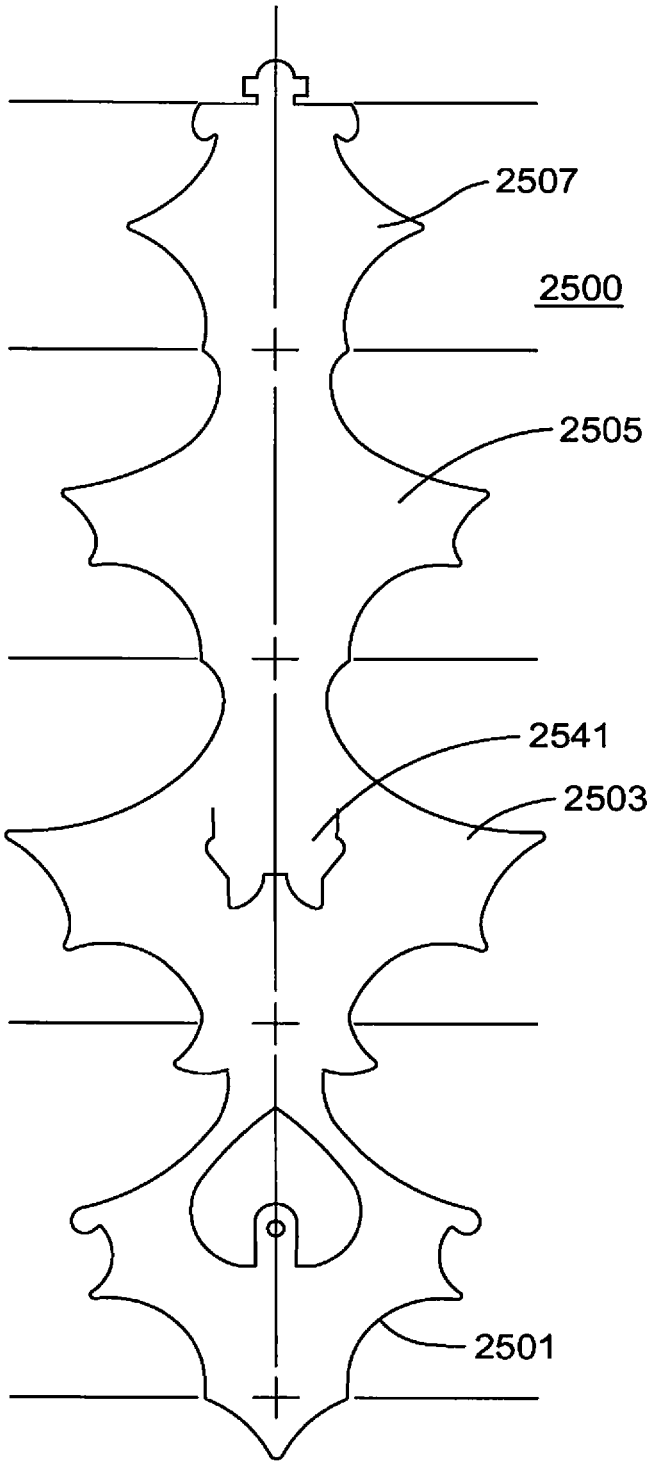
FIG. 25 illustrates a top view of the decorative object of the present invention.

FIG. 25 illustrates a decorative ornament 2500 which may include a first section 2501 which may be similar to the first section 101 of the decorative element 100, a second section 2503 which may be similar to the second section 103, a third section 2505 which may be similar to the third section 105 of the decorative ornament 100, and a fourth section 2507 which may be similar to the fourth section 107 of the decorative ornament 100.

The area 2341 may include indicia for a Halloween head as illustrated in FIG. 12 and FIG. 26.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A decorative object to be decorative, comprising:

a sheet including:

a first section having a first body member, a first transverse slot, and a first neck member that is directly connected to a second section;

the second section having a second body member, a second transverse slot, a second neck member that is directly connected to a third section, and a noncontinuous slit that defines an area for indicia;

the third section having a third body member, a third transverse slot, and a third neck member that is directly connected to a fourth section;

and the fourth section having a fourth body member, a fourth transverse slot, a fourth neck member that is directly connected to the third section, and a projecting fastener extending in the opposite direction of the third section;

wherein the first section is looped to form a first loop, the second section is looped to form a second loop around the first section, the third section is looped to form a third loop around the first and second loops, and the fourth section is looped to form a fourth loop around the first, second, and third loops;

and wherein the fastener is inserted into and cooperates with each of the first, second, third, and fourth transverse slots to fasten the first, second, third, and fourth loops into place.

2. A decorative object to be decorative as in claim 1, wherein the first section includes a hanging extending projection to hang the decorative object.

3. A decorative object to be decorative as in claim 1, wherein the noncontinuous slit defines an Angel's head.

4. A decorative object to be decorative as in claim 1, wherein the noncontinuous slit defines a cowboy hat.

5. A decorative object to be decorative as in claim 1, wherein the noncontinuous slit defines a baseball cap.

6. A decorative object to be decorative as in claim 1, wherein the noncontinuous slit defines a Halloween head.

7. A decorative object to be decorative as in claim 1, wherein the first body member includes a projecting lip which corresponds to a tail feather.

8. A decorative object to be decorative as in claim 1, wherein the first body member includes a projecting lip which corresponds to a wing feather.

* * * * *